US009482243B2

(12) United States Patent
Zhang et al.

(10) Patent No.: US 9,482,243 B2
(45) Date of Patent: Nov. 1, 2016

(54) RECIPROCATING SERVO CONTROL DEVICE FOR MAINSHAFT OF HONING MACHINE

(71) Applicants: NINGXIA YINCHUAN DAHE CNC MACHINE CO., LTD., Yinchuan (CN); BEIJING RESEARCH INSTITUTE OF AUTOMATION FOR MACHINERY INDUSTRY, Beijing (CN)

(72) Inventors: Hongjun Zhang, Yinchuan (CN); Jinchuan Zheng, Yinchuan (CN); Jianhua Xu, Yinchuan (CN)

(73) Assignees: NINGXIA YINCHUAN DAHE CNC MACHINE CO., LTD., Ningxia (CN); BEIJING RESEARCH INSTITUTE OF AUTOMATION FOR MACHINERY INDUSTRY, Beijing (CN)

( * ) Notice: Subject to any disclaimer, the term of this patent is extended or adjusted under 35 U.S.C. 154(b) by 721 days.

(21) Appl. No.: 14/025,792

(22) Filed: Sep. 12, 2013

(65) Prior Publication Data

US 2014/0013937 A1 Jan. 16, 2014

Related U.S. Application Data

(63) Continuation of application No. PCT/CN2012/072771, filed on Mar. 22, 2012.

(30) Foreign Application Priority Data

Mar. 23, 2011 (CN) ..... 2011 1 0070014

(51) Int. Cl.

| | |
|---|---|
| ***B24B 49/08*** | (2006.01) |
| ***B24B 47/06*** | (2006.01) |
| ***B24B 47/14*** | (2006.01) |
| ***B24B 47/16*** | (2006.01) |
| ***B24B 33/06*** | (2006.01) |
| ***F15B 13/02*** | (2006.01) |
| ***F15B 13/00*** | (2006.01) |
| ***B24B 33/10*** | (2006.01) |

(52) U.S. Cl.

CPC ..... *F15B 13/00* (2013.01); *B24B 33/06* (2013.01); *B24B 33/105* (2013.01); *B24B 47/16* (2013.01); *B24B 49/08* (2013.01)

(58) Field of Classification Search

CPC ..... B24B 49/08; B24B 47/06; B24B 47/14; B24B 47/16; B24B 33/00; B24B 33/02; B24B 33/10; B24B 33/105; B24B 33/082; B24B 33/06; F15B 13/00; F15B 13/02

USPC ..... 451/24, 26, 120, 124, 151, 156, 180

See application file for complete search history.

(56) References Cited

U.S. PATENT DOCUMENTS

| | | | | |
|---|---|---|---|---|
| 2,350,117 | A * | 5/1944 | Kline | B24B 33/02 451/151 |
| 2,356,223 | A * | 8/1944 | Crompton, Jr. | B24B 33/02 173/150 |
| 2,479,622 | A * | 8/1949 | Johnson | B24B 33/06 451/151 |
| 3,255,778 | A | 6/1966 | Rosebrook et al. | 137/625.69 |
| 3,324,602 | A * | 6/1967 | Wright | B24B 33/02 451/1 |
| 3,369,327 | A * | 2/1968 | Estabrook | B23Q 15/0075 451/156 |

FOREIGN PATENT DOCUMENTS

| | | | |
|---|---|---|---|
| CN | 101722466 | A | 6/2010 |
| CN | 201604070 | U | 10/2010 |
| CN | 101549474 | B | 1/2011 |
| CN | 102189480 | A | 9/2011 |
| CN | 102189481 | A | 9/2011 |
| CN | 102189482 | A | 9/2011 |
| CN | 102192203 | A | 9/2011 |
| CN | 201998043 | U | 10/2011 |
| CN | 201998044 | U | 10/2011 |
| CN | 201998053 | U | 10/2011 |
| CN | 202021540 | U | 11/2011 |
| CN | 202097649 | U | 1/2012 |

| | | | | | |
|---|---|---|---|---|---|
| CN | 102189482 | B | | 6/2013 | |
| DE | 195 08 190 | A1 | | 9/1995 | |
| EP | 1 637 256 | A1 | | 3/2006 | |
| FR | GB 1278037 | A | * | 6/1972 | ..... B23Q 15/0075 |
| GB | 1 370 827 | | | 10/1974 | |
| JP | 10-138118 | A | | 5/1998 | |

OTHER PUBLICATIONS

The extended European Search Report of corresponding European Application No. 12761068.1 issue on Jul. 17, 2014.
International Search Report of International Application No. PCT/CN2012/072771, dated May 10, 2012.
Chinese First Examination Report of corresponding China Application No. 201110070014.7, dated Jan. 23, 2013.

* cited by examiner

*Primary Examiner* — Eileen Morgan
(74) *Attorney, Agent, or Firm* — J. C. Patents

(57) ABSTRACT

A reciprocating servo control device for a mainshaft of a honing machine includes a bed body, a mainshaft mechanism, a driving system for hydraulic reversing and a control system, the driving system includes a mainshaft hydraulic cylinder and a mechanical-hydraulic servo valve, a valve body of the mechanical-hydraulic servo valve is connected to a piston rod of the mainshaft hydraulic cylinder via a connecting mechanism, a spool of the mechanical-hydraulic servo valve is connected to one end of a first connecting member, and the other end of the first connecting member is connected to a pilot displacement mechanism controlled by a servo driving and control system. The reciprocating servo control device adopts a mechanical position closed-loop and a hydraulic position closed-loop, to achieve numerical control of speed, position and reversing of the mainshaft hydraulic cylinder, thus a simple structure, reliable control, low price and easy adjustment can be realized.

16 Claims, 4 Drawing Sheets

RECIPROCATING SERVO CONTROL DEVICE FOR MAINSHAFT OF HONING MACHINE

CROSS-REFERENCE TO RELATED APPLICATIONS

This application is a continuation of International Application No. PCT/CN2012/072771, filed on Mar. 22, 2012, which claims the priority benefit of Chinese Patent Application No. 201110070014.7, filed on Mar. 23, 2011, both of which are hereby incorporated by reference in their entireties.

TECHNICAL FIELD

The present invention relates to a honing machine, specifically to a reciprocating servo control device for a mainshaft of a honing machine.

BACKGROUND

A mainshaft of a honing machine needs to perform reciprocating motion during honing process, thus numerical control technology for reciprocation of the mainshaft of a honing machine is core manufacturing technology of honing machines, which determines the performance of the honing machine as well as the level of honing process.

Currently, numerical control for reciprocation of the mainshaft has been achieved in advanced honing machines, there are two control drive methods of a reversing control system of a mainshaft hydraulic cylinder which performs reciprocation, in one way, the numerical control for reversing of the mainshaft is achieved through a control drive system with an electro-hydraulic position reversing closed-loop, which is composed of an electro-hydraulic servo proportional valve and a mainshaft displacement sensor; in the other way, a special rotary valve for honing is used, which converts reciprocating linear motion of the mainshaft to rotary motion of a control unit inside the valve, a pilot control part of the valve is driven to rotate by a motor, such rotation of the pilot control part and the above described rotation converted from the reciprocation of the mainshaft constitute a rotary mechanical-hydraulic position closed-loop via a special mechanism, and then the numerical control for reversing of the mainshaft is achieved by electrical interface of a rotary valve controller.

In above two reversing control systems of the mainshaft, for the control drive system with an electro-hydraulic position reversing closed-loop composed of an electro-hydraulic servo proportional valve and a mainshaft displacement sensor, the electro-hydraulic servo proportional valve is expensive and its requirement for working condition is harsh; on the other hand, for the reversing control system which adopts a special rotary valve for honing, linear motion of the mainshaft needs to be converted to rotary motion, and a complex system with a rotary mechanical-hydraulic position closed-loop is adopted, thus not only greatly increasing the production cost of the reversing control system, but also making commissioning and maintenance of such a system very complicated.

SUMMARY

The object of the present invention is to overcome the above technical deficiencies of the prior art, and to provide a numerical control device for controlling the actions of a mechanical-hydraulic servo valve to achieve servo control of speed, position, reversing of the mainshaft reciprocating motion of a honing machine, that is, to provide a reciprocating servo control device for a mainshaft of a honing machine, which is composed of a mechanical position closed-loop with numerical control and a hydraulic position closed-loop composed of a linear mechanical-hydraulic servo valve, whereby the speed, position and reversing of the mainshaft reciprocating motion of the honing machine is controllable.

The technical solution of the present invention includes: a bed body, a mainshaft system of a honing machine mounted on the bed body, a hydraulic reversing system and a control system, where the hydraulic reversing system includes a mainshaft hydraulic cylinder and a mechanical-hydraulic servo valve for controlling reciprocation of the mainshaft hydraulic cylinder, a valve body of the mechanical-hydraulic servo valve is connected to a piston rod of the mainshaft hydraulic cylinder via a connecting mechanism, a spool of the mechanical-hydraulic servo valve is connected to a first connecting member, the first connecting member is fixedly connected to a pilot displacement mechanism which is controlled by a driving and control system of a servo motor with position detection.

A linear guide rail is mounted on the bed body, the first connecting member or the pilot displacement mechanism is mounted on the linear guide rail.

The connecting mechanism is composed of a moving member that moves together with a mainshaft and a second connecting member mounted on the moving member, the second connecting member is connected to the valve body of the mechanical-hydraulic servo valve.

The connecting mechanism is composed of a mainshaft box mounted on one end of the piston rod of the mainshaft hydraulic cylinder and a second connecting member mounted on the mainshaft box, the second connecting member is connected to the valve body of the mechanical-hydraulic servo valve.

The pilot displacement mechanism is composed of a servo motor fixedly mounted on the bed body, an active toothed pulley mounted on an output end of the servo motor, a passive toothed pulley which corresponds to the active toothed pulley and is mounted on the bed body, and a toothed belt wound around the active toothed pulley and the passive toothed pulley, one end of the first connecting member is connected to the spool of the mechanical-hydraulic servo valve while the other end is fixed to the toothed belt, the first connecting member is connected to and matched with the linear guide rail and can slide along the linear guide rail, the servo motor is controlled by the control system.

The pilot displacement mechanism can also be composed of a servo motor fixedly mounted on the bed body, an active sprocket mounted on an output end of the servo motor, a passive sprocket which corresponds to the active sprocket and is mounted on the bed body, and a chain wound around the active sprocket and the passive sprocket, one end of the first connecting member is connected to the spool of the mechanical-hydraulic servo valve while the other end is fixed to the chain, the first connecting member is connected to and matched with the linear guide rail and can slide along the linear guide rail, the servo motor is controlled by the control system.

The pilot displacement mechanism can also be composed of a servo motor fixedly mounted on the bed body, a lead screw mounted on an output end of the servo motor, and a nut matching with the lead screw, one end of the first connecting member is connected to the spool of the mechanical-hydraulic servo valve while the other end is connected to the nut, the first connecting member is connected to and matched with the linear guide rail and can slide along the linear guide rail, the servo motor is controlled by the control system.

The pilot displacement mechanism can even be composed of a linear motor mounted on the bed body, one end of the first connecting member is connected to the spool of the mechanical-hydraulic servo valve while the other end is connected to a linear moving member of the linear motor, the linear motor is controlled by the control system.

The features of the present invention are:

1. The present invention utilizes a numerical control driving device to control movements of a spool of a mechanical-hydraulic servo valve, which can achieve servo control of speed, position, reversing of the mainshaft hydraulic cylinder, that is, a mechanical position closed-loop with numerical control and a hydraulic position closed-loop composed of a linear mechanical-hydraulic servo valve are adopted to achieve the function of the numerical control of speed, position and reversing of the hydraulic cylinder.

2. A numerical control device, which is widely used in machine tools to detect and set linear displacement, is adopted as a pilot control unit, and a mechanical-hydraulic servo valve having linear mechanical properties is used as a servo unit, thus forming two completely independent position closed-loop units. Since the former uses an electrical signal position closed-loop while the latter utilizes the servo property of the mechanical-hydraulic servo valve, commissioning of the system can be implemented in electrical aspect and in hydraulic aspect respectively, thereby reduces the difficulty of commissioning, and facilitates quick locating of the position when a problem occurs.

Compared to an existing advanced numerical control device for reciprocation, the present invention does not need an expensive electro-hydraulic servo proportional valve with a harsh requirement for working condition, and can divide an electro-hydraulic position closed-loop of the prior art into a mechanical position closed-loop with numerical control and a hydraulic position closed-loop composed of a linear mechanical-hydraulic servo valve, that is, one complex position closed-loop is divided into two relatively simple position closed-loops, thus making the commissioning of the system simple, improving the working reliability of the system, and reducing the technical requirements for an operator and the cost of the system.

Compared to a numerical control method using a special rotary valve for honing, since a commonly used linear mechanical-hydraulic servo valve is adopted instead of the special rotary valve for honing, the linear motion of the mainshaft and the spool directly constitute a servo position closed-loop, which does not need to convert the linear motion of the mainshaft to rotary motion and does not need a complex rotary mechanical-hydraulic position closed-loop either. The working principle, the mode of driving and feedback, the mechanical structure etc. of the numerical control method using a special rotary valve for honing and those of the present invention are completely different, furthermore, as the structure of the mechanical-hydraulic servo valve is simple, cost of the system is reduced, and convenience of the system maintenance is improved.

3. A mechanical-hydraulic servo valve with good linear property is adopted as an amplifying mechanism of mechanical force in the present invention, which can drive a heavy load, the application range is not limited to driving control for reciprocation of the mainshaft of a honing machine, but also applicable to various occasions where numerical control and hydraulic driving are required. The mechanical-hydraulic servo valve may be a bilateral sliding valve or a quadrilateral sliding valve.

4. The electrical control elements and the mechanical-hydraulic servo element used in the present invention have been widely used in the field of machine tool control, therefore having low price and high reliability, where the price thereof is only 1/3-1/5 of that of an imported electro-hydraulic servo proportional valve and that of a special reversing rotary valve under the technical conditions of same position control accuracy and same response speed of reversing etc. At the same time, a reciprocating servo control device for a mainshaft of a honing machine with simple structure, reliable control, low price, easy adjustment, operation and maintenance, is provided for an advanced numerical control driving system for hydraulic reversing with high requirements for the technical conditions of position control accuracy and response speed of reversing etc.

Proved by experiments, this device can meet the requirements for reciprocating driving control for the mainshaft of an advanced honing machine, and is an ideal device to replace the imported electro-hydraulic servo proportional valve and the special rotary valve, thus it has great practical significance for the development of honing machines in China.

DESCRIPTION OF EMBODIMENTS

Figure 1:
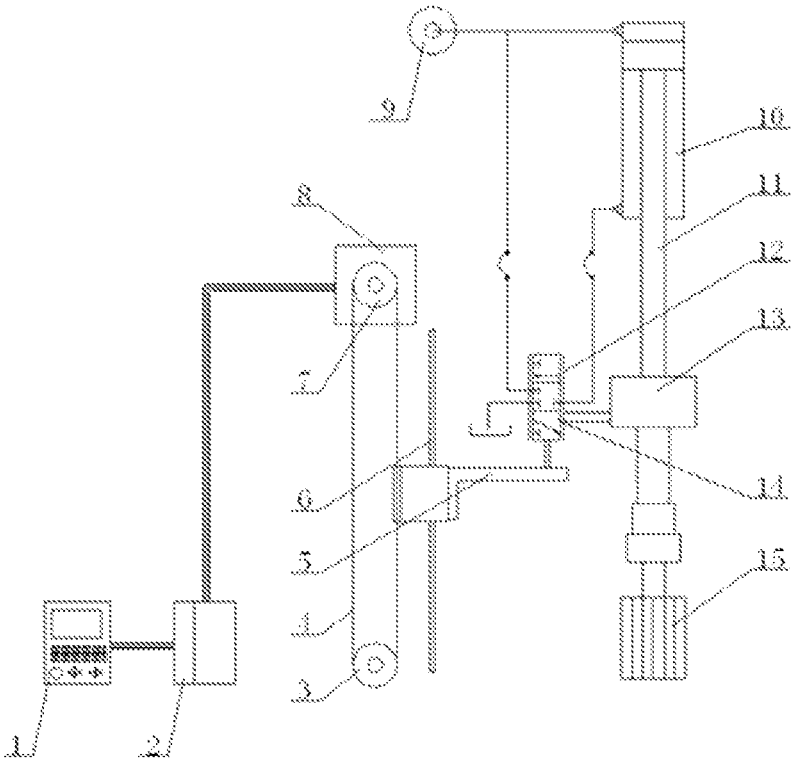
FIG. 1 is a schematic structural view of embodiment 1 according to the present invention.

Embodiment 1:

As shown in FIG. 1, a reciprocating servo control device for a mainshaft of a honing machine provided by this embodiment includes: a bed body, a mainshaft system of the honing machine mounted on the bed body, a hydraulic reversing system and a control system, where the hydraulic reversing system includes a mainshaft hydraulic cylinder 10 and a mechanical-hydraulic servo valve for controlling the reciprocation of the mainshaft hydraulic cylinder 10, a valve body 12 of the mechanical-hydraulic servo valve is connected to a piston rod 11 of the mainshaft hydraulic cylinder 10 via a connecting mechanism 13, a spool 14 of the mechanical-hydraulic servo valve is connected to a first connecting member 5, the first connecting member 5 is fixedly connected to a pilot displacement mechanism which is controlled by the control system.

A linear guide rail 6 is mounted on the bed body, the first connecting member 5 or the pilot displacement mechanism is mounted on the linear guide rail 6. The connecting mechanism 13 is composed of a moving member that moves together with the mainshaft and a second connecting member mounted on the moving member, the second connecting member is connected to the valve body 12 of the mechanical-hydraulic servo valve. Specifically, the connecting mechanism 13 is composed of a mainshaft box mounted on one end of the piston rod 11 of the mainshaft hydraulic cylinder 10 and the second connecting member mounted on the mainshaft box, the second connecting member is connected to the valve body 12 of the mechanical-hydraulic servo valve.

In this embodiment, the pilot displacement mechanism can be composed of a servo motor 8 fixedly mounted on the bed body, an active toothed pulley 7 mounted on the output end of the servo motor 8, a passive toothed pulley 3 which corresponds to the active toothed pulley 7 and is mounted on the bed body, and a toothed belt 4 wound around the active toothed pulley 7 and the passive toothed pulley 3, one end of the first connecting member 5 is connected to the spool 14 of the mechanical-hydraulic servo valve while the other end is fixed to the toothed belt 4, the first connecting member 5 is connected to and matched with the linear guide rail 6 and can slide along the linear guide rail 6, the servo motor 8 is controlled by the control system.

The mainshaft hydraulic cylinder 10 drives the mainshaft of the honing machine to reciprocate, the servo motor 8 and the linear guide rail 6 which ensures the stability of the first connecting member 5 when moving up and down are stationary, where the linear guide rail 6 is mounted on the bed body of the honing machine, the first connecting member 5 is mounted on the linear guide rail 6, a honing head 15 is mounted at the bottom end of the connecting mechanism 13. A digital controller 1, a servo driver 2 and the servo motor 8 are connected via cables, a displacement is set by the digital controller 1 according to the requirement for the displacement of the mainshaft hydraulic cylinder 10, and the pressure of the hydraulic system is supplied by a hydraulic pump 9.

During operation, the digital controller 1 sends a control instruction to the servo driver 2 according to a set program, the servo driver 2 generates a driving signal based on the control instruction to drive the output shaft of the servo motor 8 to rotate clockwise, and then the rotary motion of the servo motor 8 is converted to the linear motion of the first connecting member 5 through a reciprocating driving mechanism and the first connecting member 5 fixed to the toothed belt 4, where the reciprocating driving mechanism is composed of the active toothed pulley 7 mounted on the output end of the servo motor 8, the passive toothed pulley 3 corresponding to the active toothed pulley 7, and the toothed belt 4 wound around the active toothed pulley 7 and the passive toothed pulley 3, thereby the spool 14 of the mechanical-hydraulic servo valve connected to the first connecting member 5 is driven to move downward, so that a downward path of the mainshaft hydraulic cylinder 10 is turned on, which makes the piston rod 11 of the mainshaft hydraulic cylinder 10 move downward so as to drive the mainshaft of the honing machine and the honing head 15 mounted on the mainshaft to move downward.

On the other hand, the valve body 12 of the mechanical-hydraulic servo valve is connected to the piston rod 11 of the mainshaft hydraulic cylinder 10 via the connecting mechanism 13, the connecting mechanism 13 is composed of the moving member and the second connecting member mounted on the moving member, where the moving member moves together with the mainshaft, the second connecting member is connected to the valve body 12 of the mechanical-hydraulic servo valve. Therefore, at the same time when the piston rod 11 moves downward, the valve body 12 of the mechanical-hydraulic servo valve can be driven to move downward via the connecting mechanism 13, that is, the valve body 12 is driven to move downward following the spool 14.

When the honing head 15 moves to a set position, the digital controller 1 sends an instruction, the servo motor 8 rotates counterclockwise through the servo driver 2, thereby the spool 14 of the mechanical-hydraulic servo valve is driven to move upward, so that an upward path of the mainshaft hydraulic cylinder 10 is turned on, which makes the piston rod 11 reverse and move upward so as to drive the valve body 12 to move upward following the spool 14 via the connecting mechanism 13. In this manner, a hydraulic reciprocating servo system composed of the servo motor 8, the spool 14, the piston rod 11, the valve body 12 and the first connecting member 5 is constituted to control the mainshaft to reciprocate.

As the hydraulic reciprocating servo system reciprocates upward and downward circularly, the honing head 15 is driven to do honing process to a workpiece.

Figure 2:
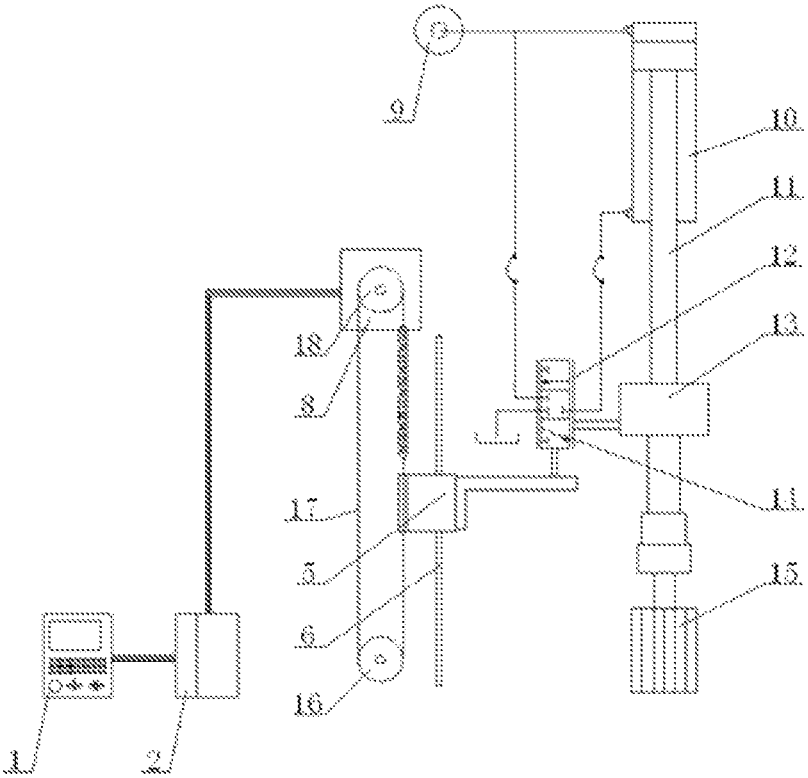
FIG. 2 is a schematic structural view of embodiment 2 according to the present invention.

Embodiment 2:

As shown in FIG. 2, based on embodiment 1, the toothed belt 4 which constitutes the pilot displacement mechanism and is mounted on the output shaft of the servo motor 8 can be replaced with a chain 17, that is, the pilot displacement mechanism is composed of an active sprocket 18 mounted on the output shaft of the servo motor 8, a passive sprocket 16 corresponding to the active sprocket 18, and the chain 17 wound around the active sprocket 18 and the passive sprocket 16, one end of the first connecting member 5 is connected to the spool 14 of the mechanical-hydraulic servo valve while the other end is fixed to the chain 17. Other parts of this embodiment are the same as those of embodiment 1.

Figure 3:
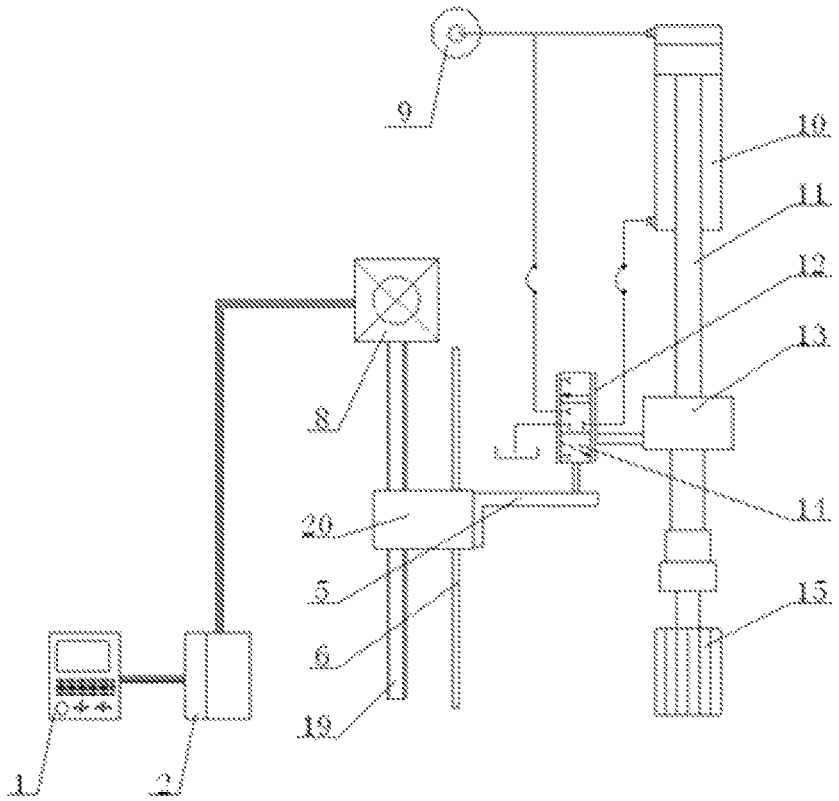
FIG. 3 is a schematic structural view of embodiment 3 according to the present invention.

Embodiment 3:

As shown in FIG. 3, based on embodiment 1, the toothed belt 4 which constitutes the pilot displacement mechanism and is mounted on the output shaft of the servo motor 8 can be replaced with a lead screw 19 and a nut 20, that is, the lead screw 19 is mounted on the output shaft of the servo motor 8, the nut 20 is connected to the first connecting member 5, one end of the first connecting member 5 is connected to the spool 14 of the mechanical-hydraulic servo valve while the other end is connected to the nut 20. Other parts of this embodiment are the same as those of embodiment 1.

Figure 4:
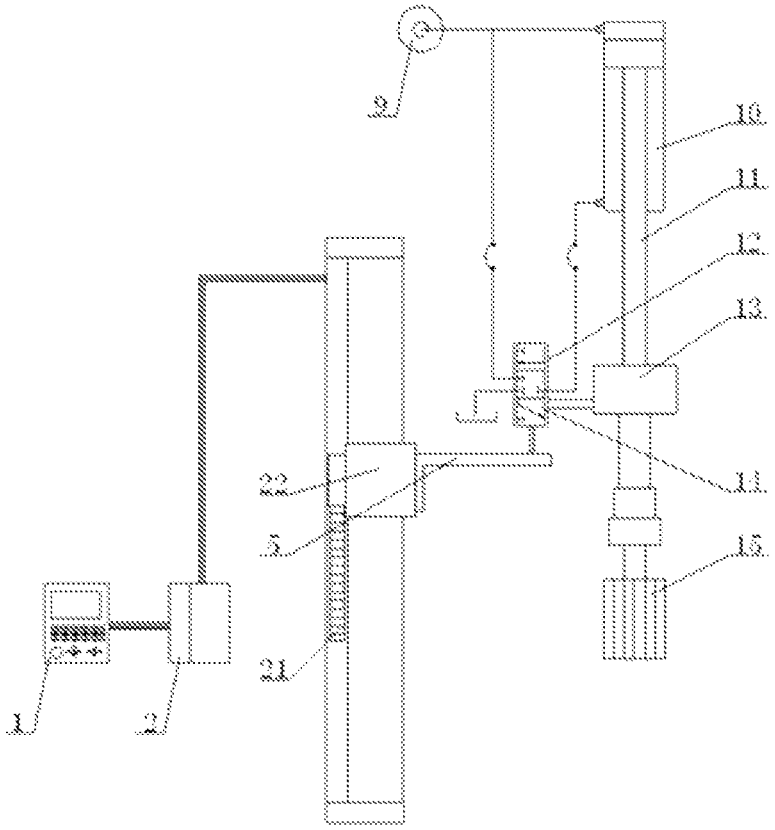
FIG. 4 is a schematic structural view of embodiment 4 according to the present invention.

Embodiment 4:

As shown in FIG. 4, based on embodiment 1, the pilot displacement mechanism composed of the toothed belt 4 mounted on the output shaft of the servo motor 8 can be replaced with a linear motor 21, one end of the first connecting member 5 is connected to the spool 14 of the mechanical-hydraulic servo valve while the other end is connected to a linear moving member 22 of the linear motor 21, other parts of this embodiment are the same as those of embodiment 1, the linear motor 21 is controlled by the digital controller 1 and the servo driver 2.

The working process of controlling the hydraulic reciprocating servo system to reciprocate upward and downward circularly by the reciprocating servo control device for the mainshaft of a honing machine according to embodiments 2-4 of the present invention can refer to embodiment 1, which will not be discussed herein.

What is claimed is:

1. A reciprocating servo control device for a mainshaft of a honing machine, comprising a bed body, a mainshaft system of the honing machine mounted on the bed body, a hydraulic reversing system and a control system, wherein the hydraulic reversing system comprises a mainshaft hydraulic cylinder (10) and a mechanical-hydraulic servo valve for controlling reciprocation of the mainshaft hydraulic cylinder, a valve body (12) of the mechanical-hydraulic servo valve is connected to a piston rod (11) of the mainshaft hydraulic cylinder via a connecting mechanism (13), a spool (14) of the mechanical-hydraulic servo valve is connected to a first connecting member (5), the first connecting member (5) is fixedly connected to a pilot displacement mechanism which is controlled by the control system.

2. The device according to claim 1, wherein a linear guide rail (6) is mounted on the bed body, the first connecting member (5) or the pilot displacement mechanism is mounted on the linear guide rail.

3. The device according to claim 1, wherein the connecting mechanism (13) is composed of a moving member which moves together with the mainshaft and a second connecting member mounted on the moving member, the second connecting member is connected to the valve body (12) of the mechanical-hydraulic servo valve.

4. The device according to claim 1, wherein the connecting mechanism (13) is composed of a mainshaft box mounted on one end of the piston rod (11) of the mainshaft hydraulic cylinder (10) and a second connecting member mounted on the mainshaft box, the second connecting member is connected to the valve body (12) of the mechanical-hydraulic servo valve.

5. The device according to claim 1, wherein the pilot displacement mechanism is composed of a servo motor (8) fixedly mounted on the bed body, an active toothed pulley (7) mounted on an output end of the servo motor (8), a passive toothed pulley (3) which corresponds to the active toothed pulley (7) and is mounted on the bed body, and a toothed belt (4) wound around the active toothed pulley (7) and the passive toothed pulley (3), one end of the first connecting member (5) is connected to the spool (14) of the mechanical-hydraulic servo valve while the other end is fixed to the toothed belt (4), the first connecting member (5) is connected to and matched with a linear guide rail (6) and slides along the linear guide rail (6), the servo motor (8) is controlled by the control system.

6. The device according to claim 2, wherein the pilot displacement mechanism is composed of a servo motor (8) fixedly mounted on the bed body, an active toothed pulley (7) mounted on an output end of the servo motor (8), a passive toothed pulley (3) which corresponds to the active toothed pulley (7) and is mounted on the bed body, and a toothed belt (4) wound around the active toothed pulley (7) and the passive toothed pulley (3), one end of the first connecting member (5) is connected to the spool (14) of the mechanical-hydraulic servo valve while the other end is fixed to the toothed belt (4), the first connecting member (5) is connected to and matched with the linear guide rail (6) and slides along the linear guide rail (6), the servo motor (8) is controlled by the control system.

7. The device according to claim 3, wherein the pilot displacement mechanism is composed of a servo motor (8) fixedly mounted on the bed body, an active toothed pulley (7) mounted on an output end of the servo motor (8), a passive toothed pulley (3) which corresponds to the active toothed pulley (7) and is mounted on the bed body, and a toothed belt (4) wound around the active toothed pulley (7) and the passive toothed pulley (3), one end of the first connecting member (5) is connected to the spool (14) of the mechanical-hydraulic servo valve while the other end is fixed to the toothed belt (4), the first connecting member (5) is connected to and matched with a linear guide rail (6) and slides along the linear guide rail (6), the servo motor (8) is controlled by the control system.

8. The device according to claim 1, wherein the pilot displacement mechanism is composed of a servo motor (8) fixedly mounted on the bed body, an active sprocket (18) mounted on an output end of the servo motor (8), a passive sprocket (16) which corresponds to the active sprocket (18) and is mounted on the bed body, and a chain (17) wound around the active sprocket (18) and the passive sprocket (16), one end of the first connecting member (5) is connected to the spool (14) of the mechanical-hydraulic servo valve while the other end is fixed to the chain (17), the first connecting member (5) is connected to and matched with a linear guide rail (6) and slides along the linear guide rail (6), the servo motor (8) is controlled by the control system.

9. The device according to claim 2, wherein the pilot displacement mechanism is composed of a servo motor (8) fixedly mounted on the bed body, an active sprocket (18) mounted on an output end of the servo motor (8), a passive sprocket (16) which corresponds to the active sprocket (18) and is mounted on the bed body, and a chain (17) wound around the active sprocket (18) and the passive sprocket (16), one end of the first connecting member (5) is connected to the spool (14) of the mechanical-hydraulic servo valve while the other end is fixed to the chain (17), the first connecting member (5) is connected to and matched with the linear guide rail (6) and slides along the linear guide rail (6), the servo motor (8) is controlled by the control system.

10. The device according to claim 3, wherein the pilot displacement mechanism is composed of a servo motor (8) fixedly mounted on the bed body, an active sprocket (18) mounted on an output end of the servo motor (8), a passive sprocket (16) which corresponds to the active sprocket (18) and is mounted on the bed body, and a chain (17) wound around the active sprocket (18) and the passive sprocket (16), one end of the first connecting member (5) is connected to the spool (14) of the mechanical-hydraulic servo valve while the other end is fixed to the chain (17), the first connecting member (5) is connected to and matched with a linear guide rail (6) and slides along the linear guide rail (6), the servo motor (8) is controlled by the control system.

11. The device according to claim 1, wherein the pilot displacement mechanism is composed of a servo motor (8) fixedly mounted on the bed body, a lead screw (19) mounted on an output end of the servo motor (8), and a nut (20) matching with the lead screw (19), one end of the first connecting member (5) is connected to the spool (14) of the mechanical-hydraulic servo valve while the other end is connected to the nut (20), the first connecting member (5) is connected to and matched with a linear guide rail (6) and slides along the linear guide rail (6), the servo motor (8) is controlled by the control system.

12. The device according to claim 2, wherein the pilot displacement mechanism is composed of a servo motor (8) fixedly mounted on the bed body, a lead screw (19) mounted on an output end of the servo motor (8), and a nut (20) matching with the lead screw (19), one end of the first connecting member (5) is connected to the spool (14) of the mechanical-hydraulic servo valve while the other end is connected to the nut (20), the first connecting member (5) is connected to and matched with the linear guide rail (6) and slides along the linear guide rail (6), the servo motor (8) is controlled by the control system.

13. The device according to claim 3, wherein the pilot displacement mechanism is composed of a servo motor (8) fixedly mounted on the bed body, a lead screw (19) mounted on an output end of the servo motor (8), and a nut (20) matching with the lead screw (19), one end of the first connecting member (5) is connected to the spool (14) of the mechanical-hydraulic servo valve while the other end is connected to the nut (20), the first connecting member (5) is connected to and matched with a linear guide rail (6) and slides along the linear guide rail (6), the servo motor (8) is controlled by the control system.

14. The device according to claim 1, wherein the pilot displacement mechanism is composed of a linear motor (21) mounted on the bed body, one end of the first connecting member (5) is connected to the spool (14) of the mechanical-hydraulic servo valve while the other end is connected to a linear moving member (22) of the linear motor (21), the linear motor (21) is controlled by the control system.

15. The device according to claim 2, wherein the pilot displacement mechanism is composed of a linear motor (21) mounted on the bed body, one end of the first connecting member (5) is connected to the spool (14) of the mechanical-hydraulic servo valve while the other end is connected to a linear moving member (22) of the linear motor (21), the linear motor (21) is controlled by the control system.

16. The device according to claim 3, wherein the pilot displacement mechanism is composed of a linear motor (21) mounted on the bed body, one end of the first connecting member (5) is connected to the spool (14) of the mechanical-hydraulic servo valve while the other end is connected to a linear moving member (22) of the linear motor (21), the linear motor (21) is controlled by the control system.

* * * * *